US009864312B1

(12) United States Patent
Okano et al.

(10) Patent No.: US 9,864,312 B1
(45) Date of Patent: Jan. 9, 2018

(54) FIXING DEVICE THAT CAN SUPPRESS VARIATION IN TEMPERATURE, AND IMAGE FORMING APPARATUS HAVING THE FIXING DEVICE

(71) Applicants: KABUSHIKI KAISHA TOSHIBA, Tokyo (JP); TOSHIBA TEC KABUSHIKI KAISHA, Tokyo (JP)

(72) Inventors: Yoshiaki Okano, Mishima Shizuoka (JP); Noboru Furuyama, Odawara Kanagawa (JP); Yuki Kawashima, Tagata Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/411,401

(22) Filed: Jan. 20, 2017

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2039
USPC ..... 399/69
See application file for complete search history.

(56) References Cited

U.S. PATENT DOCUMENTS 9,501,004 B2 11/2016 Kikuchi
2015/0168888 A1* 6/2015 Kikuchi ..... G03G 15/2053 399/33

FOREIGN PATENT DOCUMENTS

JP 2002343549 A * 11/2002
JP 2005190728 A * 7/2005

* cited by examiner

*Primary Examiner* — Quana M Grainger
(74) *Attorney, Agent, or Firm* — Patterson & Sheridan, LLP

(57) ABSTRACT

A fixing device includes a magnetic flux generation unit, an auxiliary heating body formed of material that generates heat from the magnetic flux generated by the magnetic flux generation unit, a rotatable fixing belt having opposing first and second ends in a direction of its rotational axis and a material that generates heat from the magnetic flux, a magnetic flux shield in contact with the auxiliary heating body and having first and second openings that expose the auxiliary body, the first and second openings being symmetrical with respect to a center point along the rotational axis between the first and second ends, a temperature sensor in contact with the auxiliary heating body through one of the first and second openings of the magnetic flux shield shielding member, and a driver that controls power supplied to the magnetic flux generation unit in accordance with signals from the temperature sensor.

18 Claims, 6 Drawing Sheets

FIXING DEVICE THAT CAN SUPPRESS VARIATION IN TEMPERATURE, AND IMAGE FORMING APPARATUS HAVING THE FIXING DEVICE

FIELD

Embodiments described herein relate to a fixing device that can suppress variation in temperature, and an image forming apparatus having the fixing device.

BACKGROUND

An image forming apparatus such as copy machines or multi-function peripherals (MFP) may include a fixing device that fixes an image by heating a sheet to which a toner image is transferred.

Regarding the heating performed by the fixing device, a safety device is normally used in order to prevent an abnormal increase in a temperature. Such a safety device measures a temperature of an auxiliary heating member, and stops the heating when abnormal heating is detected. In the fixing device, a shielding member and the auxiliary heating member are physically separated from each other, so a thermostat used for measuring the temperature has access to the auxiliary heating member of which the temperature is to be measured.

In the aforementioned fixing device, because the shielding member and the auxiliary heating member are physically separated from each other, the thermal conductivity between the two members is low. When the shielding member and the auxiliary heating member are physically close to each other in order to improve the thermal conductivity, it is necessary to provide an opening in the shielding member for temperature measurement. The opening in the shielding member causes temperature variation in a fixing belt or in the auxiliary heating member.

DETAILED DESCRIPTION

Hereinafter, embodiments will be described. A fixing device according to an embodiment includes a magnetic flux generation unit, an auxiliary heating body positioned to receive magnetic flux generated by the magnetic flux generation unit and being formed of a material that generates heat from the magnetic flux, a fixing belt that is rotatable around an axis, disposed to face the magnetic flux generation unit, includes opposing first and second ends in the axial direction, and includes a material that generates heat from the magnetic flux, a magnetic flux shield in contact with the auxiliary heating body and having first and second openings that expose the auxiliary body, the first and second openings being arranged symmetrically with respect to a center point along the axis between the first and second ends of the fixing belt, a temperature sensor in contact with the auxiliary heating body through one of the first and second openings of the magnetic flux shield shielding member, and a driver for the magnetic flux generation unit, that controls power supplied to the magnetic flux generation unit in accordance with signals from the temperature sensor.

First Embodiment

Figure 1:
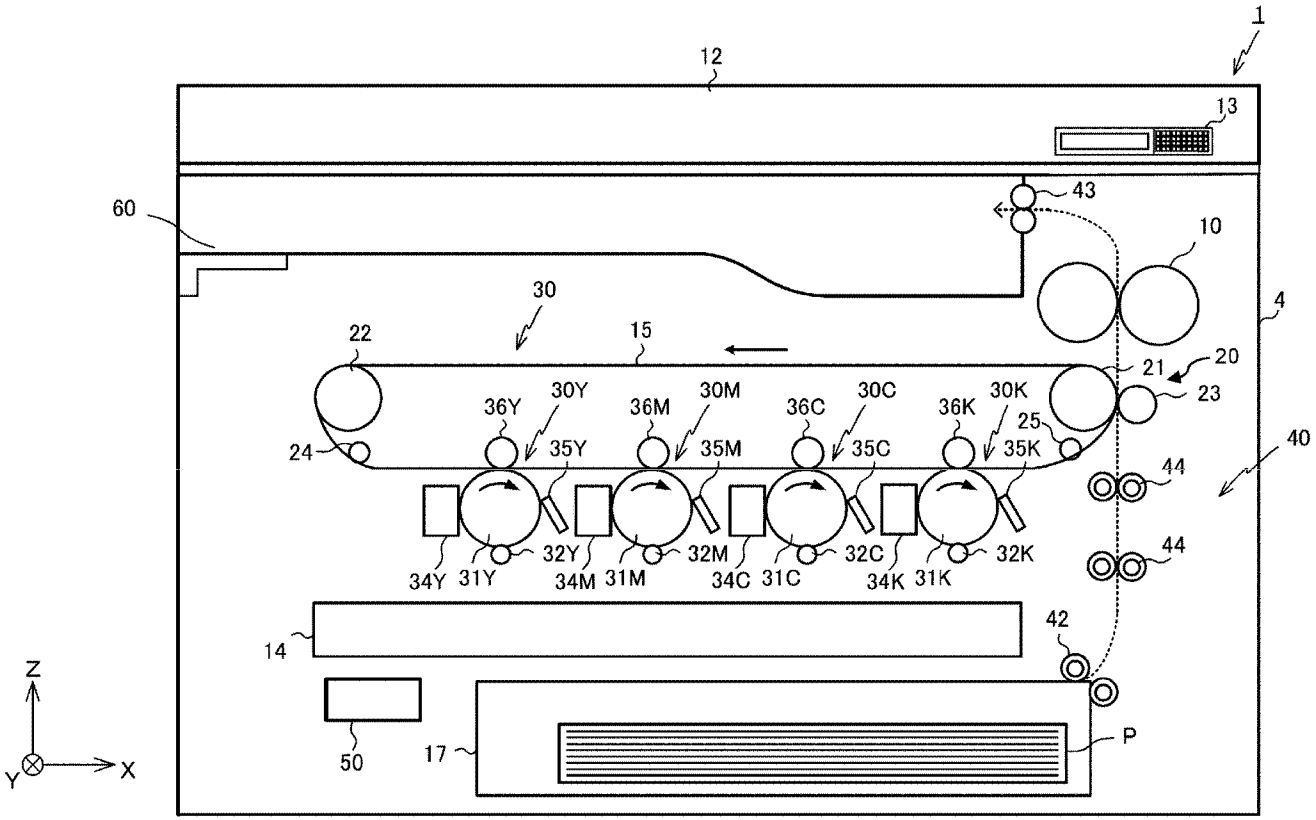
FIG. 1 is a diagram illustrating a configuration of a MFP according to a first embodiment.

As illustrated in the embodiment of FIG. 1, a MFP 1 is an image forming apparatus that includes a fixing device 10, a scanner 12, an input and output unit 13, a laser exposure device 14, a sheet feeding unit 17, an image forming unit 30, a transporting system 40, and a sheet discharge unit 60, all disposed within, or otherwise coupled to, a housing 4. The sheet feeding unit 17 includes a sheet cassette which is filled with sheet S corresponding to a printing medium. The MFP 1 includes a control device 50 which controls the above-described components.

The XYZ coordinate axes on the lower left side in FIG. 1 are provided to aid understanding of the figures.

The scanner 12 reads a document image to form an image by the MFP 1. The scanner 12 includes the input and output unit 13. The input and output unit 13 includes a touch panel-type input and output portion and a keyboard. With such a physical configuration, when receiving the input to the MFP 1 from a user, the input and output unit 13 outputs screen display.

The sheet feeding unit 17 includes a sheet feeding cassette for storing sheet P, corresponding to a printing medium, and a sheet feeding roller for discharging the sheet S.

The image forming unit 30 forms an image in the MFP 1.

The image forming unit 30 includes four sets of image forming stations 30Y, 30M, 30C, and 30K, and an intermediate transfer belt 15. The image forming station (the image forming stations 30Y, 30M, 30C, and 30K) transfers an image corresponding to each basic color of yellow (Y), magenta (M), cyan (C), and black (K) contained in a color image printed by the MFP 1 to the intermediate transfer belt 15.

A toner image containing one or more colors of Y, M, C, and K transferred to the intermediate transfer belt 15 is transferred to the sheet S by a secondary transfer unit 20 which includes a secondary transfer roller 23 and a driving roller 21.

Figure 2:
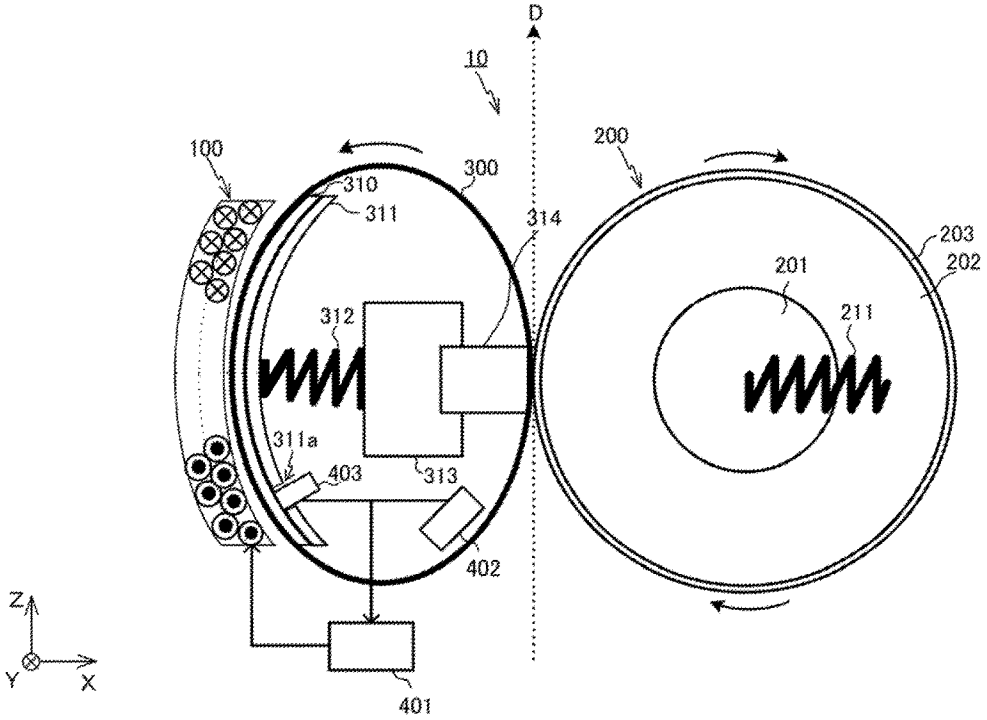
FIG. 2 is a diagram illustrating a configuration of a fixing device.

With the configuration illustrated in FIG. 2, the fixing device 10 fixes the toner image transferred from the secondary transfer unit 20 onto the sheet S. The fixing device 10 of the embodiment is an induction heating (IH) type fixing device. The fixing device 10 will be described below.

The transporting device 40 transports the sheet S by using a plurality of rollers including a pickup roller 42 and a resist roller 44. The transporting device 40 transports the sheet S to the secondary transfer unit 20 from the sheet feeding unit 17. In addition, the transporting device 40 transports the sheet S, to which the toner image is transferred by using the secondary transfer unit 20, to the fixing device 10. Further, the transporting device 40 transports the sheet S on which the toner image is fixed by the fixing device 10 to the sheet discharge unit 60.

Specifically, when the printing is started, first, the pickup roller 42 draws out the sheet S from the sheet feeding cassette. The sheet S drawn out from the sheet feeding cassette is transported between the intermediate transfer belt 15 and the secondary transfer roller 23 by the resist roller 44. The sheet S is compressed between the intermediate transfer belt 15 and the secondary transfer roller 23 such that the toner image is secondarily transferred, and is transported to the fixing device 10 by using two of the aforementioned rollers. In this way, the sheet S is supplied to the fixing device 10. A discharge roller 43 discharges the "sheet" P, on which the toner image has been fixed by the fixing device 10, to the discharge unit 60.

The control device 50 includes a central processing unit (CPU), a main storage portion corresponding to an operation region of the CPU, and an auxiliary storage portion including a non-volatile memory, such as a magnetic disk, and an addressable memory. The control device further includes a driving system for operating the fixing device 10, the secondary transfer unit 20, the image forming unit 30, and the transporting device 40. The control device 50 drives the rollers and drivable portions of the fixing device 10, the image forming unit 30, and the transporting device 40 by using the driving system. The control device 50 is connected to the fixing device 10, the image forming unit 30, the laser exposure device 14, and the transporting device 40, and controls the functions thereof.

Next, a structure of an image forming station (the image forming stations 30Y, 30M, 30C, and 30K) will be described.

The image forming station 30Y includes a photoconductive drum 31Y, a charging device 32Y which is disposed around the photoconductive drum 31Y, a developing device 34Y, and a cleaner 35Y. The photoconductive drum 31Y is rotated clockwise when seen in the +Y direction as indicated by the arrow. With such a configuration, the image forming station 30Y transfers a yellow (Y) image transferred to the intermediate transfer belt 15 from the control device 50.

At the time of transferring the image, the charging device 32Y charges an outer periphery surface of the photoconductive drum 31Y. The surface of the photoconductive drum 31Y is irradiated with laser light emitted from the laser exposure device 14. Irradiation of the surface of the photoconductive drum 31Y by laser light forms an electrostatic latent image on the surface of the photoconductive drum 31Y.

The developing device 34Y is filled with a developer formed of a color (yellow (Y)) toner, corresponding to an image to be formed, and a carrier. The developing device 34Y supplies the toner to the electrostatically imaged surface of the photoconductive drum 31Y. With this, a yellow toner image is developed on the photoconductive drum 31Y.

The image forming stations 30M, 30C, and 30K which transfer magenta (M), cyan (C), and black (K) toner images have the same structure and function.

That is, the image forming stations 30M, 30C, and 30K transfer the magenta (M), cyan (C), and black (K) toner images to the intermediate transfer belt 15 by the photoconductive drums (photoconductive drums 31M, 31C, and 31K), charging devices (charging devices 32M, 32C, and 32K) which are disposed around the photoconductive drums, developing devices (developing devices 34M, 34C, and 34K), and cleaners (cleaners 35M, 35C, and 35K). The structure and function of each of the image forming stations 30M, 30C, and 30K are the same as those of the corresponding image forming station 30Y.

The intermediate transfer belt 15 transports superimposed toner images which are formed by the image forming stations 30Y, 30M, 30C, and 30K. The intermediate transfer belt 15 is wound by a driving roller 21, a driven roller 22, and two tension rollers (tension rollers 24 and 25). The intermediate transfer belt 15 is pushed toward the photoconductive drums 31Y, 31M, 31C, and 31K of the image forming stations 30Y, 30M, 30C, and 30K by the primary transfer rollers 36Y, 36M, 36C, and 36K of the image forming stations 30Y, 30M, 30C, and 30K. In addition, the secondary transfer roller 23 is disposed in the vicinity of the driving roller 21. The secondary transfer roller 23 pushes the intermediate transfer belt 15 toward the driving roller 21.

In the image forming unit 30, when the driving roller 21 is driven, the intermediate transfer belt 15 is rotated in an arrow direction. In accordance with the rotation of the intermediate transfer belt 15, the toner image formed in each of the photoconductive drums 31Y, 31M, 31C, and 31K of the image forming stations 30Y, 30M, 30C, and 30K is sequentially transferred to the intermediate transfer belt 15. After transferring the toner images, toners remaining on the surfaces of the photoconductive drums 31Y, 31M, 31C, and 31K are cleaned by the cleaners 35Y, 35M, 35C, and 35K.

If the printing is performed by the MFP 1 configured as described above, first, the control device 50 drives the pickup roller 42 by using the driving system so as to draw out the sheet S from the sheet feeding unit 17. In addition, the control device 50 drives the resist roller 44 so as to transport the sheet S between the intermediate transfer belt 15 and the secondary transfer roller 23.

In parallel with the above operation, in the image forming unit 30, the toner image formed in each of the photoconductive drums 31Y, 31M, 31C, and 31K of the image forming stations 30Y, 30M, 30C, and 30K is sequentially transferred to the intermediate transfer belt 15. With this, a toner image made of any of a yellow (Y) toner, a magenta (M) toner, a cyan (C) toner, and a black (K) toner, as needed, is formed on the intermediate transfer belt 15.

The toner images formed on the intermediate transfer belt 15 are transferred to the sheet S by compressing the sheet S and the intermediate transfer belt 15 together using the secondary transfer roller 23 and the driving roller 21.

The sheet S on which the toner image is transferred is transported to the fixing device 10 by the transporting device 40. In order to fix the toner image on the sheet S, the fixing device 10 heats the sheet S so as to melt the toner. Further, the fixing device 10 cause the melted toner to be infiltrated onto the sheet S by compressing the heated sheet S and the intermediate transfer belt 15. In this way, an image is formed on the sheet S. The sheet S on which the image is fixed by the fixing device 10 is discharged toward the sheet discharge unit 60 by the sheet discharge roller 43.

As illustrated in FIG. 2, the fixing device 10 includes an excitation coil 100, a fixing belt 300 which is positioned in the vicinity of the excitation coil 100, a compression roller 200, and an IH driving device 401. The transporting device 40 transports the sheet S on which the toner image is formed along a path, identified by the dotted arrow D, between the fixing belt 300 and the compression roller 200. The IH driving device 401 includes a power source for supplying high-frequency current to the excitation coil 100 and a control device for adjusting the supply current based on a temperature measurement result of the fixing belt 300.

The excitation coil 100 is an induction coil which uses a litz wire which is obtained by a plurality of bundles of copper wires coated with heat-resistant polyamide-imide which is, for example, an insulating material. The litz wire of the excitation coil 100 is wound around a point Po (visible in the views of FIGS. 5 and 7). The excitation coil 100 includes a peripheral port ion which is wound by a lead wire.

The excitation coil 100 generates an alternating magnetic flux (electromagnetic wave) by the high-frequency current which is applied from the IH driving device 401.

The compression roller 200 is a roller for compressing the sheet S together with the fixing pad while being rotated in the direction opposite to the fixing belt 300. The compression roller 200 includes a core 201, an elastic layer 202, which is stacked on the outer periphery surface of the core 201, an elastic material 211, and a perfluoro alkoxy alkane (PFA) tube 203. The core 201 is formed of, for example, an aluminum pipe having an outer diameter of 30 mm and a thickness of 3 mm. The elastic layer 202 is formed of silicon rubber having the thickness of 200 μm. The PFA tube 203 is a tube made of PFA with which the elastic layer 202 is coated.

The fixing belt 300 is a looped belt, including a copper material (a heating layer 300*c*), which generates heat by receiving a magnetic flux from the excitation coil 100. The fixing belt 300 is driven by the driving system of the control device 50, and is rotated in the direction (counter-clockwise direction in FIG. 2) the sheet S is transported along the compression roller 200. A point on the fixing belt 300 describes a curve in space as the fixing belt 300 rotates. That curve defines a plane. The direction orthogonal to the plane (the Y direction in the drawings) is hereinafter referred to as a longitudinal direction. A magnetic metal material 310, a shielding plate 311, an elastic member 312, a holding member 313, a compression pad 314, a temperature sensor 402, and a thermostat 403 are disposed in the inside of the fixing belt 300.

The holding member 313 is a member fixed to the housing 4 for stabilizing each component disposed on the inside of the fixing belt 300 including the compression pad 314 and the elastic member 312.

The compression pad 314 is formed of a heat resistant phenolic resin. A surface (surface on the +X side) of the compression pad 314 that contacts the fixing belt 300 is formed into a curved shape to match the curved surface of the inside of the fixing belt 300. Further, the compression pad 314 applies pressure to the compression roller 200 via the fixing belt 300. The compression pad 314 applies pressure to an inner surface of the fixing belt 300, which in turn applies pressure to the compression roller 200 so as to form a nip allowing the sheet S to pass through between the fixing belt 300 and the compression roller 200. In the nip, when the sheet S comes in contact with the fixing belt 300, the toner is melted. In addition, the sheet S is compressed by the compression roller 200 and the compression pad 314 such that the melted toner is infiltrated onto the sheet S and thereby an image is formed.

The elastic member 312 is, for example, a press spring, and one end (an end on the +X side) thereof is fixed to the holding member 313. In addition, the magnetic metal material 310 is attached to the other end (an end on the −X side) of the elastic member 312 via the shielding plate 311. Both of the shielding plate 311 and the magnetic metal material 310 are formed into a curved shape along the curved surface of the inside of the fixing belt 300.

The temperature sensor 402 measures the temperature of the fixing belt 300, and outputs a signal in accordance with the measured temperature to the IH driving device 401. The IH driving device 401 controls the power supplied to the excitation coil 100 in accordance with the information on the temperature of the fixing belt 300 received from the temperature sensor 402. In this way, the temperature of the fixing belt 300 is feedback-controlled so as to reduce temperature variation in the fixing process.

The fixing device 10 has a thermostat 403 in addition to the temperature sensor 402. Thermostat 403 has a bimetallic thermostat configuration, and interrupts power from the IH driving device 401 to the excitation coil 100 if the temperature of the fixing belt 300 is abnormally increased. In the embodiment, the thermostat 403 contacts the surface of the magnetic metal material 310 through an opening 311*a* provided through the shielding plate 311. For example, the thermostat 403 detects the abnormal heating by being changed from an on state to an off state if the temperature of the surface of the magnetic metal material 310 is higher than a specific temperature (interruption threshold) of 220° C. The circuit is set such that the power supply to the excitation coil 100 from the IH driving device 401 is disconnected when the thermostat 403 is turned off.

In this way, the temperature of the fixing belt 300 is controlled to be in a range of 150° C. to 160° C. by using the temperature sensor 402 and the thermostat 403.

Figure 3:
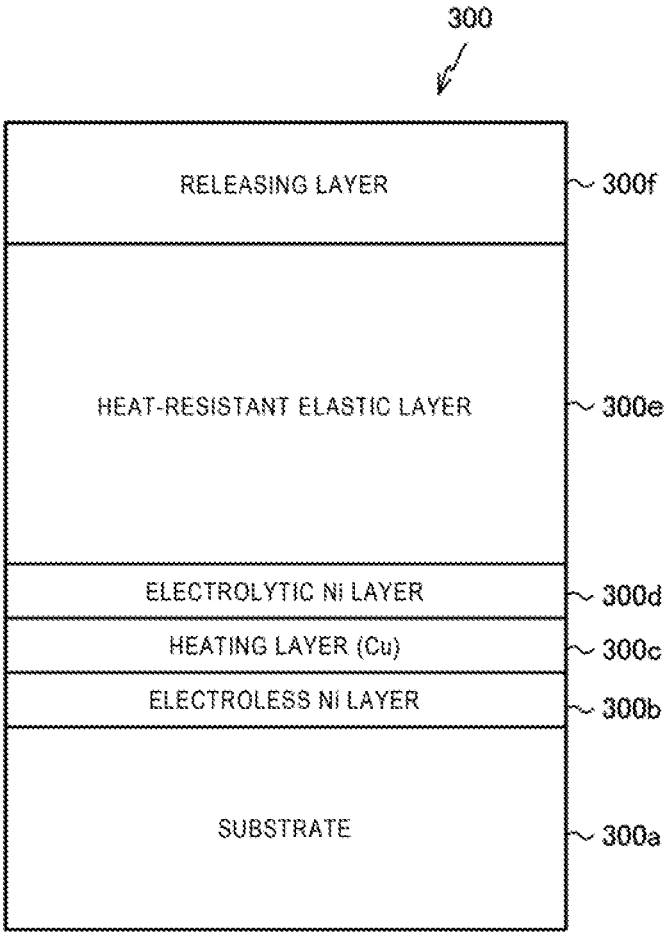
FIG. 3 is a diagram illustrating a layer structure of a fixing belt.

As illustrated in FIG. 3, the fixing belt 300 has a configuration in which a substrate 300*a*, an electroless Ni layer 300*b*, a heating layer 300*c*, an electrolytic Ni layer 300*d*, a heat-resistant elastic layer 300*e*, and a releasing layer 300*f* are stacked. As oriented in FIG. 2, the substrate 300*a* of the fixing belt 300 is closest to the excitation coil 100, and the releasing layer 300*f* is furthest from the excitation coil 100. In the embodiment, the substrate 300*a* is a polyimide (PI) resin having a thickness of 70 μm. The electroless Ni layer 300*b* having a thickness of 0.5 μm is formed on the substrate 300*a*. The electroless Ni layer 300*b* is a plating film obtained by electroless nickel plating.

The heating layer 300*c* is formed on the electroless Ni layer 300*b*. The heating layer 300*c* is a layer formed by copper plating (with the thickness of 10 μm), and is susceptible to induction heating by the magnetic flux generated by the excitation coil 100. In the embodiment, in order to make the heat capacity of the entire fixing belt 300 small, the thickness of the copper (Cu) layer of the heating layer 50*a* is thin, for example, 10 μm.

The electrolytic Ni layer 300*d*, which is a protective layer, is formed on the heating layer 300*c*. The electrolytic Ni layer 300*d* is a plating film having a thickness of 8 μm, which is obtained by electroless nickel plating. The heat-resistant elastic layer 300*e* is formed on the electrolytic Ni layer 300*d*. The heat-resistant elastic layer 300*e* is coated silicon rubber having a thickness of 200 μm. The releasing layer 300*f* is formed on the heat-resistant elastic layer 300*e*. Here, the releasing layer 300*f* is a perfluoro alkoxy alkane (PFA) tube having a thickness of 30 μm. The releasing layer 300*f* contacts the sheet S.

The magnetic metal material 310 (FIG. 2), which is a magnetic shunt material, is formed of a low-temperature magnetic metal material in a plate shape. The magnetic metal material 310 is an arcuate plate material following the curvature of fixing belt 300, and is positioned at a place corresponding to the excitation coil 100 on the inside of the fixing belt 300. The magnetic metal material 310 generates heat from eddy currents caused the magnetic flux generated by the excitation coil 100. The heat generated by the magnetic metal material 310 heats the heating layer 300*c* of the fixing belt, and serves as an auxiliary heating plate for auxiliary heating the fixing belt 300.

The magnetic metal material 310 is formed of a magnetic shunt alloy of metal with permeability that decreases (for example, iron (Fe) and nickel (Ni)) when the temperature is equal to or higher than Curie point temperature. When the temperature of the fixing belt 300 is increased to some extent, the magnetic flux coupling to the fixing belt 300 is decreased. Here, the Curie point temperature is lower than the interruption threshold of the thermostat 403, which is set to be 200° C., for example. In this way, the fixing belt 300 is prevented from being excessively heated.

The shielding plate 311 is formed of a non-magnetic material such as aluminum (Al). The shielding plate 311 is an arcuate plate material following the curvature of the fixing belt 300, and is positioned at a place corresponding to the excitation coil 100 on the inward of the magnetic metal material 310 with respect to the fixing belt 300. The non-magnetic nature of the shielding plate 311 reduces coupling of the magnetic flux on the inside of the fixing belt 300 by shielding the fixing belt 300 from magnetic flux generated by the excitation coil 100.

In the embodiment, as illustrated in FIG. 2, the magnetic metal material 310 is integrally formed with the shielding plate 311. Further, the entire outer periphery surface of the magnetic metal material 310 is in contact with the inside surface (the substrate 300*a*) of the fixing belt 300. The magnetic metal material 310 and the shielding plate 311 are installed in the positions corresponding to the excitation coil 100, and thus heat is conducted through three layers of the fixing belt 300, the magnetic metal material 310, and the shielding plate 311 in the longitudinal direction.

As the cross-sectional area for transferring heat in the longitudinal direction becomes larger, the thermal conductivity of the system including the fixing belt 300 becomes larger. In this way, feeding speed of the sheet S is increased. Also, rotation speed of the fixing belt 300 is increased, resulting in reduced temperature variation of the fixing belt 300 in the vicinity of the excitation coil 100.

Figure 4:
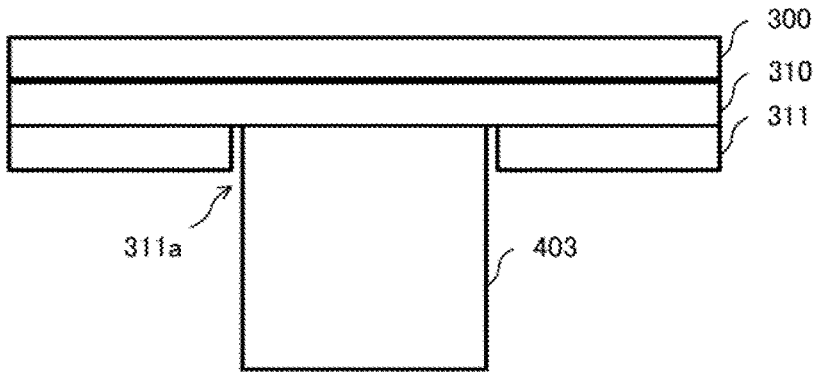
FIG. 4 is a cross-sectional view of a notch portion of a shielding plate of the fixing belt.

The shielding plate 311 has a first opening 311*a* and a second opening 311*b* formed in a side of the shielding plate 311. The first and second openings 311*a* and 311*b* may each be a notch portion. The notch portion 311*a* and the notch portion 311*b* are notched into an end side of the shielding plate 311 (see FIG. 5). The thermostat 403 is inserted into the notch portion 311*a*. As illustrated in cross-sectional view (FIG. 4), the thermostat 403 comes in contact with the magnetic metal material 310, of which the temperature is to be measured, from the inside of the fixing belt 300 by passing through the notch portion 311*a*. The opening of the notch portion 311*a* preserves the magnetic flux shielding effect of the shielding plate 311 while providing more direct contact between the magnetic material 310 and the thermostat 403. The notch 311*b* maintains symmetry of the shielding plate 311 to prevent the temperature variation.

When the temperature of the fixing belt 300 is abnormally increased (when being heated at the temperature beyond the abnormal temperature which is predefined), heat is conducted to the magnetic metal material 310 which is in contact with the surface of the fixing belt 300. The thermostat 403 detects the temperature of the magnetic material 310. If the detected temperature exceeds a specific temperature (for example, 200° C.), due to the heat conducted from the fixing belt 300 or self-heat generation by the eddy current generated by the excitation coil 100, the IH driving device 401 interrupts the power supply to the excitation coil 100. As such, the thermostat 403 serves as a safety device with respect to abnormal heating of the system including the magnetic metal material 310 and the fixing belt 300.

In the embodiment, the notch portion 311*a* serves as a passage such that thermostat 403 contacts the magnetic metal material 310 from the inside of the shielding plate 311. With this structure, the thermostat 403 can directly detect the temperature of the magnetic metal material 310.

Figure 5:
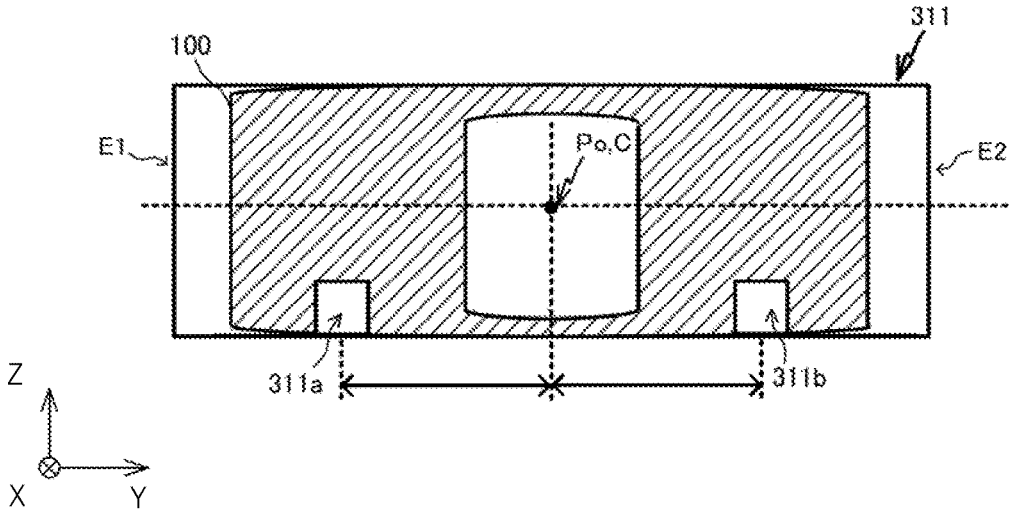
FIG. 5 is a diagram illustrating positions of the notch portion on the shielding plate.

The position of the notch portion in the shielding plate 311 will be described with reference to FIG. 5. FIG. 5 is a diagram showing the shielding plate illustrated in FIG. 3 viewed from the inside of the fixing belt 300 in the −X direction. Both of the notch portion 311*a* and the notch portion 311*b* are formed by being notched into the side extending in the longitudinal direction, which is the direction orthogonal to the plane defined by the rotation curve of the fixing belt 300, also the Y-axis direction of FIG. 5, of the aluminum shielding plate 311.

The shielding plate 311 shields the magnetic flux generated by the excitation coil 100 as indicated with hatched lines in FIG. 5. Here, as illustrated by both arrows in FIG. 5, the notch portion 311*a* and the notch portion 311*b* are substantially symmetric to each other around a line (the line in the X-axis direction), as an axis, which passes through the point (center point C) corresponding to the center point Po of the excitation coil 100, and is orthogonal to the longitudinal direction. In other words, in the shielding plate 311, if a first end in the longitudinal direction is defined as E1, the second end opposite the first end is defined as E2, and the center point therebetween is defined as C, the notch portion 311*a* is disposed between the center point (c) and the first end (E1), and the notch portion 311*b* is disposed between the center point (c) and the second end (E2). The openings of the notch portion 311*a* and the notch portion 311*b* are also substantially symmetrical to each other.

In the embodiment, the notch portion 311*a* and the notch portion 311*b* are symmetrically positioned in the longitudinal direction, and thus the thermal conductivity force and electromagnetic shielding ability are well-balanced. Therefore, the temperature variation is less in the system including the fixing belt 300 and the magnetic metal material 310 in the longitudinal direction.

Figure 6:
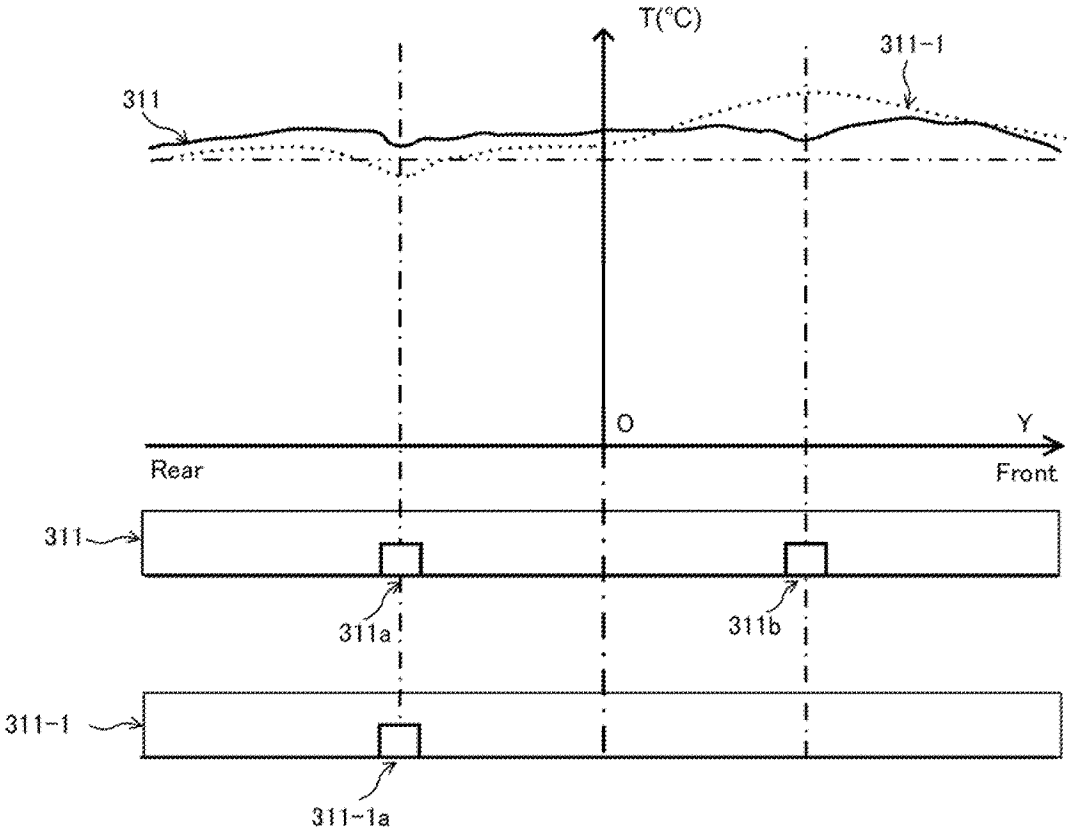
FIG. 6 is a diagram illustrating the impact of the notch portion on the temperature.

A difference in the temperature variation between the case of including both of the notch portion 311*a* and the notch portion 311*b*, and the case of only including the notch portion 311*a* will be described with reference to FIG. 6. FIG. 6 is a temperature measurement experiment using two different shielding plates. In one case, the fixing belt 300 is coupled to the shielding plate 311 and the magnetic material 310. In another case, the fixing belt 300 is coupled to a shielding plate 311-1, which has the first opening 311*a* but does not have the second opening 311*b*, and the magnetic metal material 310. The experiment is performed by rotating the fixing belt 300 at the same speed using either shielding plate.

In FIG. 6, a vertical axis represents a temperature and a horizontal axis represents a distance along the fixing belt 300 in the longitudinal direction. A two-dot chain line represents a fixing failure generation temperature, and when a temperature is lower than the fixing failure generation temperature, it is not easy to melt the toner. A solid line among the curves represents a temperature of the fixing belt when using the shielding plate 311 of the present application, and a dotted line represents a result of measuring the temperature of the fixing belt when using the shielding plate 311-1. As illustrated in FIG. 6, if the notch portion 311*a* and the notch portion 311*b* are present, the temperatures are substantially symmetrical to each other in the longitudinal direction. If the notch portion 311*b* is not present, a portion having a temperature which is lower than the fixing failure generation line is observed in the vicinity of the notch portion 311*a*. On the other hand, if the notch portion 311*a* and the notch portion 311*b* are both present, the temperature is above the fixing failure generation line along the entire fixing belt 300. In this way, when the notch portion 311*b* is provided, it is possible to suppress the temperature variation in the longitudinal direction even if the notchportion 311*a* is provided so as to provide contact between the thermostat 403 and the magnetic metal material 310 for the safety device.

Note that, as illustrated in FIG. 6, the notch portion 311*a* and the notch portion 311*b* are located at portions of the shielding plate 300 corresponding to the peripheral portions of excitation coil 300, which have a large number of turns of the conductor, rather than at the center portion of the excitation coil 300, which has a small number of turns of the conductor. In the embodiment, regarding the relation between the excitation coil 100 and the magnetic metal material 310, the magnetic metal material 310 more strongly generates heat at a location corresponding to the portion of the excitation coil 100 having a large number of turns. In the shielding plate 311 of the embodiment, the notch portion 311*a* is positioned corresponding to the peripheral portion having a large number of turns (with high heat generation capacity) as compared to the center portion. Accordingly, the portion which strongly generates heat contacts the thermostat 403, and thus it is possible to increase safety against thermal runaway.

As described above, the fixing device 10 of the embodiment includes the excitation coil 100, the fixing belt 300 which is adjacent to the excitation coil 100 and includes the heating layer 300*c* for generating heat by receiving the magnetic flux generated by the excitation coil 100, and the magnetic metal material 310, in which at least a portion is inscribed to the fixing belt 300, and which generates heat by receiving the magnetic flux. In addition, the fixing device 10 further includes the shielding plate 311, which is inscribed to at least a portion of the magnetic metal material 310 and shields the magnetic flux generated by the excitation coil 100. The shielding plate 311 includes the notch portion 311*a*, which leads to the magnetic metal material 310, disposed between the first end E1 and the center point C, and the notch portion 311*b*, which leads to the magnetic metal material 310, disposed between the second end E2 and the center point C so as to be symmetric to the notch portion 311*a*. The thermostat 403 interrupts the power supply to the excitation coil 100 so as to suppress the magnetic flux if the temperature detected by the thermostat 403 is equal to or higher than the specific temperature (a shielding temperature).

In the fixing device 10 having such a configuration, the fixing belt 300, the magnetic metal material 310, and the shielding plate 311 come in contact with each other, and thus the thermal conductivity is high. In addition, the notch portion 311*b* which is symmetric to the notch portion 311*a* in a line is further provided so as to install the thermostat 403, and thus the temperature variation is less.

In order to speed up the start of heating, the thickness of the heating layer 300*c* is thin, for example, 10 μm, and the heat capacity of the fixing belt 300 is small. When the heating layer 300*c* is thin, the thermal resistance of the fixing belt 300 is increased, leading to more temperature variation. However, when the shielding plate 311 and the magnetic metal material 310 come in contact with each other, and with the fixing belt 300 by the above-described configuration, it is possible to reduce temperature variation during heating.

In addition, the shielding plate 311 comes in contact with the magnetic metal material 310 in the periphery of the notch portion 311*a* and the notch portion 311*b*.

Therefore, it is possible to align thermal properties and shielding performance in the notch portion 311*a* and the notch portion 311*b*.

The notch portion 311*a* and the notch portion 311*b* are notch portions formed by notching a side of the shielding plate 311.

Thus, it is possible to provide the notch portion 311*a* and the notch portion 311*b* with a relatively easy process. Further, it is possible to improve the accuracy of the alignment.

The excitation coil 100 includes a center potion and a peripheral portion which is tightly wound by a conducting line as compared with the center portion. The shielding plate 311 includes the notch portion 311*a* and the notch portion 311*b* at positions corresponding to the peripheral portions of the excitation coil 100 on the upper surface of the shielding plate.

Thus, it is possible to install the thermostat 403, which is the safety device, in a portion having a large amount of eddy currents (a large heating amount) among the inside surface of the magnetic metal material 310. Accordingly, it is possible to secure high level of safety while suppressing the occurrence of the temperature variation.

In addition, around the point corresponding to the center point Po of the excitation coil 100, the entire inner surface of the magnetic metal material 310 and the entire outer surface of the shielding plate 311 come in contact with each other. Further, the magnetic metal material 310 comes in contact with the fixing belt 300 on the entire outer peripheral surface.

Therefore, the magnetic metal material 310, the shielding plate 311, and the fixing belt 300 form a system in which the thermal conductivity is high in a region where the heating is performed by the excitation coil 100, and has less variation in the thermal conductivity.

Note that, the shielding plate 311 is formed of an aluminum material. Accordingly, it is possible to obtain a shielding effect, and easy processing for the notch portion with low cost.

Second Embodiment

Next, the second embodiment will be described.

Figure 7:
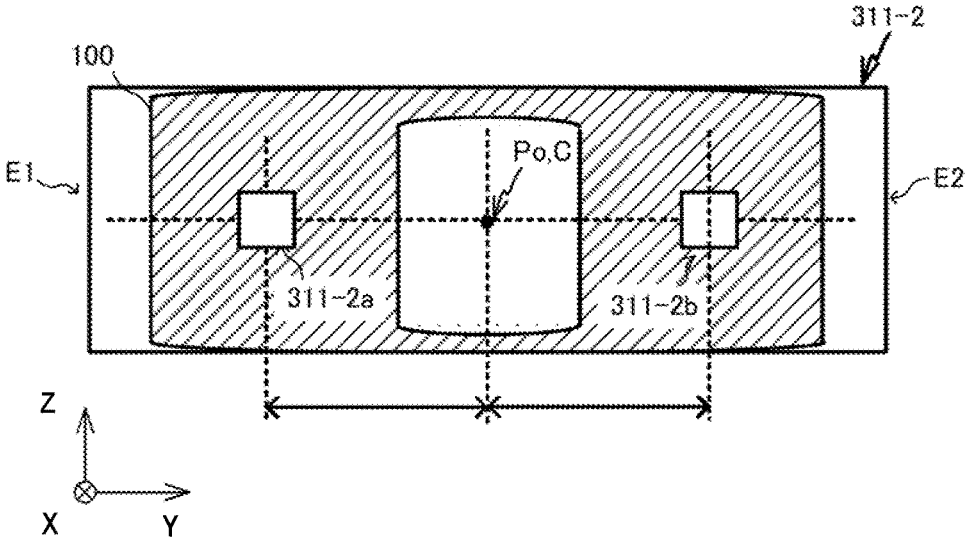
FIG. 7 is a diagram illustrating positions of a hole portion which is formed on the shielding plate according to a second embodiment.

As illustrated in FIG. 7, a fixing device 10 which is provided in a MFP 1 according to the second embodiment includes a shielding plate 311-2 including a first portion 311-2*a* and second portion 311-2*b*, each of which is a hole portion. The hole portion 311-2*a* and the hole portion 311-2*b* replace the notch portions as a openings. Other components are the same as those of the fixing device 10 in the first embodiment.

According to the configuration of the embodiments, the openings can be provided not only on the side but also at the center of the shielding plate, and thus a high degree of freedom in design is realized.

As illustrated in FIG. 7, also in the case of the shielding plate 311-2 of the fixing device 10 according to the second embodiment, the hole portion 311-2*a* and the hole portion 311-2*b* are symmetric to each other. Specifically, the hole portion 311-2*a* is symmetric to the hole portion 311-2*b* around a line (the line in the Z-axis direction) as an axis, which passes through the point corresponding to the center point Po of the excitation coil 100, and is orthogonal to the longitudinal direction. In other words, in the fixing belt 300, when one end in the longitudinal direction is set as E1, the other end facing the one end is set as E2, and the center point therebetween is set as C, the hole portion 311-2*a* is disposed between the center point (c) and the one end (E1), and the hole portion 311-2*b* is disposed between the center point (c) and the other one end (E2). In addition, the hole portion

311-2*a* and the hole portion 311-2*b* are positioned in parallel in the longitudinal direction. Thus, the occurrence of the temperature variation in the longitudinal direction is reduced.

As described above, the shielding plate 311-2 of the embodiment is provided with the hole portion 311-2*a* and the hole port ion 311-2*b* which are hole port ions exposing the magnetic metal material 310, instead of the notch portion.

Accordingly, the fixing device 10 of the embodiment has a high degree of freedom in design of installing the safety device.

As described above, the embodiments are described. However, the embodiment is not limited to the above embodiments. For example, the structure of the fixing belt 300 is not limited to the illustration of FIG. 3.

The fixing belt 300 may has any structure as long as it is provided with a heating layer (heating material) which receives the magnetic flux generated by the excitation coil 100 and causes the eddy current so as to generate heat, and a layer structure for supporting the heating layer. For example, as the material for forming the heating layer, nickel (Ni), iron (Fe), stainless steel, aluminum (Al), and silver (Ag) may be used instead of copper. The heating layer may be formed of two or more types of alloy. Further, even with the heating layer having a structure in which two or more types of metals are layered, the same effect can be obtained.

The magnetic metal material 310 is not limited to metal, and may be formed a resin or the like which includes a magnetic powder as long as it has magnetic properties.

In addition, the material constituting the shielding plate 311 is not limited to aluminum. For example, stainless steel or copper may be used as long as it can shield the magnetic flux.

In the embodiment, an example in which the shape of the opening portion is a square is illustrated in the drawings. However, the shape of the opening portion is not limited to the square. For example, the opening may be rectangular or circular so long as a thermostat fits the opening. Further, the shapes of two opening portions are desirable the same as each other, but are not necessarily the same as each other.

In addition, the thermostat is employed as the safety device in the embodiment. However, the safety device is not limited to the thermostat. For example, the thermostat can be replaced with a well-known unit that suppresses (or stop) the power supply to the coil if the temperature is higher than a threshold. For example, instead of the thermostat, a combination of a thermistor and a control circuit which is programmed to cut the power supply when detecting a temperature is equal to or higher than a specific temperature can be used as the safety device.

In the above-described embodiments, the outer side surface of the shielding plate 311 and the inner side surface of the magnetic metal material 310 come in contact with each other on the entire surface. However, the outer side surface of the shielding plate and the inner side surface of the magnetic metal material do not necessarily come in contact with each other on the entire surface. For example, the same effect can be obtained even when some portions are separated from each other, as long as the portions in which the opening portions are formed come in contact with each other. Note that, regarding the longitudinal direction, it is desired that the shielding plate 311 and the magnetic metal material 310 continuously come in contact with each other in a belt shape.

Similarly, an example in which the entire outer side surface of the magnetic metal material 310 comes in contact with the fixing belt 300 is described above; however, if some portions are separated from each other, the embodiment can obtain the same effect. Meanwhile, even in this case, it is desired that the portions corresponding to the opening portions come in contact with each other, and regarding the longitudinal direction, it is desired that the magnetic metal material 310 and the fixing belt 300 continuously come in contact with each other in a belt shape.

The embodiments have been described as described above; however, these embodiments are merely described as examples, and are not intended to limit the scope of the invention. Additional embodiments described herein may be embodied in various other forms, and various omissions, substitutions, and changes can be made without departing from the scope of the invention. The embodiments and the modifications are included within the scope and spirit of the invention, and are included in the inventions described in claims and the equivalent scope thereof.

What is claimed is:

1. A fixing device comprising:

a magnetic flux generation unit;

an auxiliary heating body positioned to receive magnetic flux generated by the magnetic flux generation unit and being formed of a material that generates heat from the magnetic flux;

a fixing belt that is rotatable around an axis, disposed to face the magnetic flux generation unit, includes opposing first and second ends in the axial direction, and includes a material that generates heat from the magnetic flux;

a magnetic flux shield in contact with the auxiliary heating body and having first and second openings that expose the auxiliary body, the first and second openings being arranged symmetrically with respect to a center point along the axis between the first and second ends of the fixing belt;

a temperature sensor in contact with the auxiliary heating body through one of the first and second openings of the magnetic flux shield shielding member; and a driver for the magnetic flux generation unit, that controls power supplied to the magnetic flux generation unit in accordance with a signal from the temperature sensor.

2. The device according to claim 1, wherein the driver decreases the power supplied to the magnetic flux generation unit if the signal from the temperature sensor indicates that a temperature of the auxiliary heating body is above a threshold temperature.

3. The device according to claim 1, wherein the first opening and second opening are formed through one side of the magnetic flux shield.

4. The device according to claim 1, wherein the one side of the magnetic flux shield is parallel to the axis.

5. The device according to claim 1, wherein the first opening and the second opening are holes formed through the magnetic flux shield.

6. The device according to claim 1, wherein the magnetic flux generation unit includes a center portion and a peripheral portion which is tightly wound by a conducting wire around the center portion, and wherein the first opening and the second opening are positions corresponding to the peripheral portion of the magnetic flux generation unit.

7. The device according to claim 1, wherein an entire outer surface of the magnetic flux shield is in contact with an inner surface of the auxiliary heating body, and an entire outer surface of the auxiliary heating body is in contact with the fixing belt.

8. The device according to claim 1, wherein the magnetic flux shield is formed of an aluminum material.

9. An image forming apparatus comprising:

a developing device configured to develop an image on a printing medium;

a fixing device configured to fix the image developed on the printing medium; and a sheet discharge device which discharges the printing medium onto which the developed image is fixed by the fixing device, wherein the fixing device includes a magnetic flux generation unit;

an auxiliary heating body positioned to receive magnetic flux generated by the magnetic flux generation unit and being formed of a material that generates heat from the magnetic flux;

a fixing belt that is rotatable around an axis, disposed to face the magnetic flux generation unit, includes opposing first and second ends in the axial direction, and includes a material that generates heat from the magnetic flux;

a magnetic flux shield in contact with the auxiliary heating body and having first and second openings that expose the auxiliary body, the first and second openings being arranged symmetrically with respect to a center point along the axis between the first and second ends of the fixing belt;

a temperature sensor in contact with the auxiliary heating body through one of the first and second openings of the magnetic flux shield shielding member; and a driver for the magnetic flux generation unit, that controls power supplied to the magnetic flux generation unit in accordance with a signal from the temperature sensor.

10. The apparatus according to claim 9, wherein the driver decreases the power supplied to the magnetic flux generation unit if the signal from the temperature sensor indicates that a temperature of the auxiliary heating body is above a threshold temperature.

11. The apparatus according to claim 9, wherein the first opening and second opening are formed through one side of the magnetic flux shield.

12. The apparatus according to claim 9, wherein the one side of the magnetic flux shield is parallel to the axis.

13. The apparatus according to claim 9, wherein the first opening and the second opening are holes formed through the magnetic flux shield.

14. The apparatus according to claim 9, wherein the magnetic flux generation unit includes a center portion and a peripheral portion which is tightly wound by a conducting wire around the center portion, and wherein the first opening and the second opening are positions corresponding to the peripheral portion of the magnetic flux generation unit.

15. The apparatus according to claim 9, wherein an entire outer surface of the magnetic flux shield is in contact with an inner surface of the auxiliary heating body, and an entire outer surface of the auxiliary heating body is in contact with the fixing belt.

16. The apparatus according to claim 9, wherein the magnetic flux shield is formed of an aluminum material.

17. A method of controlling temperature variations in a fixing device that includes a magnetic flux generation unit, an auxiliary heating body positioned to receive magnetic flux generated by the magnetic flux generation unit and being formed of a material that generates heat from the magnetic flux, a fixing belt that is rotatable around an axis, disposed to face the magnetic flux generation unit, includes opposing first and second ends in the axial direction, and includes a material that generates heat from the magnetic flux, and a magnetic flux shield in contact with the auxiliary heating body and having first and second openings that expose the auxiliary body, the first and second openings being arranged symmetrically with respect to a center point along the axis between the first and second ends of the fixing belt, said method comprising:

sensing first and second temperatures using a temperature sensor in contact with the auxiliary heating body through one of the first and second openings of the magnetic flux shield shielding member; and controlling power supplied to the magnetic flux generation unit in accordance with an output signal of the temperature sensor.

18. The method according to claim 17, wherein the power supplied to the magnetic flux generation unit is decreased if the output signal from the temperature sensor indicates that a temperature of the auxiliary heating body is above a threshold temperature.

* * * * *